US012535282B2

(12) United States Patent
Stroda

(10) Patent No.: US 12,535,282 B2
(45) **Date of Patent: *Jan. 27, 2026**

(54) BOLT STOP ACTUATOR FOR USE IN A FIREARM

(71) Applicant: DIAMONDBACK FIREARMS LLC, Cocoa, FL (US)

(72) Inventor: James Dean Stroda, Cocoa, FL (US)

(73) Assignee: DIAMONDBACK FIREARMS LLC, Cocoa, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/615,598

(22) Filed: Mar. 25, 2024

(65) Prior Publication Data

US 2024/0230258 A1 Jul. 11, 2024

Related U.S. Application Data

(63) Continuation of application No. 17/977,028, filed on Oct. 31, 2022, now Pat. No. 11,940,239, which is a continuation of application No. 17/397,294, filed on Aug. 9, 2021, now Pat. No. 11,486,665, which is a continuation of application No. 16/933,634, filed on Jul. 20, 2020, now Pat. No. 11,085,715.

(60) Provisional application No. 62/876,315, filed on Jul. 19, 2019.

(51) Int. Cl.

| | |
|---|---|
| ***F41A 3/68*** | (2006.01) |
| ***F41A 9/65*** | (2006.01) |
| ***F41A 17/36*** | (2006.01) |
| *F41A 3/66* | (2006.01) |

(52) U.S. Cl.

CPC ..... *F41A 3/68* (2013.01); *F41A 9/65* (2013.01); *F41A 17/36* (2013.01); *F41A 3/66* (2013.01)

(58) Field of Classification Search

CPC .... F41A 3/68; F41A 9/65; F41A 17/36; F41A 3/66

USPC ..... 42/69.02

See application file for complete search history.

(56) References Cited

U.S. PATENT DOCUMENTS

| | | | | |
|---|---|---|---|---|
| 3,846,928 | A * | 11/1974 | Ruger | F41A 17/36 89/138 |
| 7,661,219 | B1 | 2/2010 | Knight, Jr. | |
| 8,359,966 | B1 * | 1/2013 | Brotherton | F41A 17/36 89/181 |
| 9,091,499 | B2 | 7/2015 | Overstreet | |
| 10,018,437 | B2 * | 7/2018 | Phipps | F41A 17/42 |
| 10,180,298 | B2 * | 1/2019 | Noonan | F41A 17/36 |
| 10,670,359 | B2 | 6/2020 | Indruch | |

(Continued)

OTHER PUBLICATIONS

"Final Office Action received for U.S. Appl. No. 17/977,028, mailed on Aug. 29, 2023."

(Continued)

*Primary Examiner* — Joshua E Freeman
(74) *Attorney, Agent, or Firm* — Kutak Rock LLP

(57) ABSTRACT

A bolt stop actuator is disclosed. The actuator may include a lift arm, a first leg extending from a point proximate to an end of the lift bar and generally perpendicular therefrom, a second leg extending in the same direction from the lift bar as the first leg, and a projection extending from the lift bar and configured to contact a follower of an empty magazine when the bolt stop actuator is assembled into a firearm. Neither the first leg, nor the second leg, include apertures positioned distal to the lift arm.

17 Claims, 6 Drawing Sheets

(56) References Cited

U.S. PATENT DOCUMENTS

| | | | | |
|---|---|---|---|---|
| 11,085,715 | B2 | 8/2021 | Stroda | |
| 11,486,665 | B2 | 11/2022 | Stroda | |
| 11,940,239 | B2 | 3/2024 | Stroda | |
| 2009/0249672 | A1* | 10/2009 | Zedrosser | F41A 17/36 42/6 |
| 2011/0247483 | A1 | 10/2011 | Overstreet | |
| 2012/0167424 | A1* | 7/2012 | Gomez | F41A 35/06 42/14 |
| 2017/0045324 | A1* | 2/2017 | Zeman | C01B 35/04 |
| 2017/0160032 | A1* | 6/2017 | Overstreet | F41A 17/36 |
| 2017/0241729 | A1* | 8/2017 | Gangl | F41A 3/66 |
| 2017/0284761 | A1 | 10/2017 | Lewis | |
| 2017/0299303 | A1* | 10/2017 | Phipps | F41A 17/36 |
| 2019/0137202 | A1 | 5/2019 | Facchini | |
| 2019/0316861 | A1* | 10/2019 | Johnson, Jr. | F41A 17/42 |
| 2020/0182571 | A1* | 6/2020 | Noonan | F41A 3/66 |
| 2020/0263944 | A1 | 8/2020 | Harris | |
| 2020/0300565 | A1 | 9/2020 | Romano | |
| 2021/0018284 | A1 | 1/2021 | Stroda | |
| 2021/0372719 | A1 | 12/2021 | Stroda | |
| 2023/0052688 | A1 | 2/2023 | Stroda | |

OTHER PUBLICATIONS

"Non-Final Office Action received for U.S. Appl. No. 17/977,028, mailed on Feb. 16, 2023."

"Notice of Allowance received for U.S. Appl. No. 16/933,634 ,Mailed on Apr. 5, 2021".

"Notice of Allowance Received for U.S. Appl. No. 17/397,294, mailed on Jun. 30, 2022".

"Notice of Allowance received for U.S. Appl. No. 17/977,028 ,Mailed on Nov. 13, 2023".

* cited by examiner

BOLT STOP ACTUATOR FOR USE IN A FIREARM

CROSS-REFERENCE TO RELATED APPLICATIONS

This application is a continuation of co-pending U.S. application Ser. No. 17/977,028, filed on Oct. 31, 2022, which is a continuation of U.S. application Ser. No. 17/397,294, filed on Aug. 9, 2021, now U.S. Pat. No. 11,486,665, which is a continuation of U.S. application Ser. No. 16/933,634, filed on Jul. 20, 2020, now U.S. Pat. No. 11,085,715, and claims priority pursuant to 35 U.S.C. § 119(e) to then co-pending U.S. Provisional Patent Application Ser. No. 62/876,315, filed Jul. 19, 2019, the entire disclosures of which are incorporated herein by reference.

BACKGROUND

This specification relates generally to firearm components. In particular, this specification relates to an improved bolt stop actuator for use in conjunction with a bolt stop in a semiautomatic firearm.

The present specification provides a bolt stop actuator that is retained without additional pins, resulting in simplified manufacturing and assembly processes.

DETAILED DESCRIPTION

Figure 1:
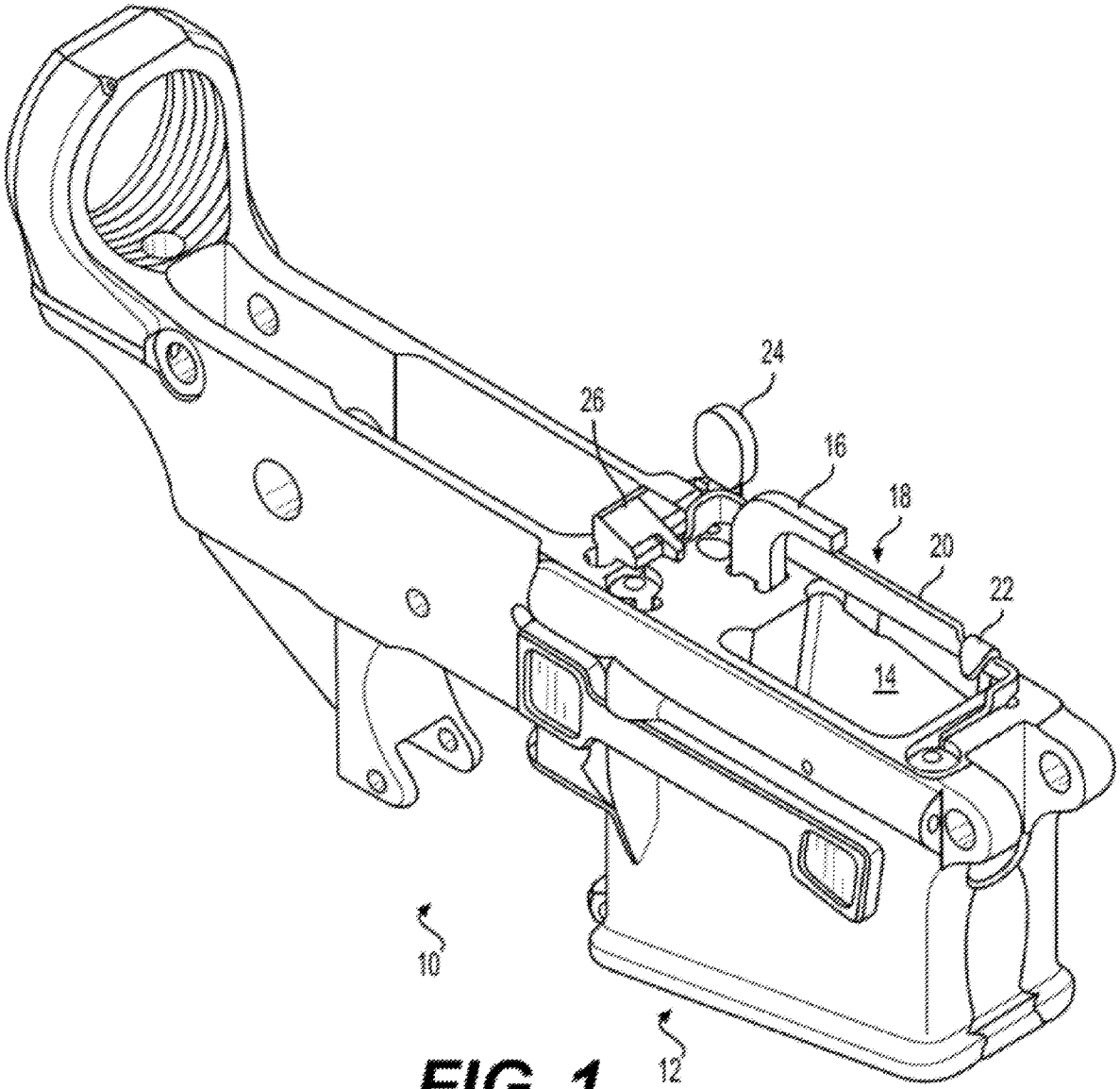
FIG. 1, is a perspective view of a firearm receiver including a bolt stop actuator.

Referring to FIG. 1, a firearm receiver 10, shown as a modified AR-15 pattern lower receiver is provided and includes a magazine well 12 having an upper opening 14. An ejector 16 extends forward from a position to the rear of magazine well 12. Ejector 16 is positioned to contact the rear of shell casing when the casing is extracted, thus causing the casing or round to be ejected.

Bolt stop actuator 18 is pivotally mounted to receiver 10 and includes lift arm 20 and projection 22. Projection 22 is curved from a top portion of lift arm 20 to provide a contact point for a magazine follower. When a magazine is inserted into magazine well 12, it extends to or through opening 14. When an empty magazine is seated in receiver 10, the follower of the magazine contacts projection 22 and urges lift arm 20 upwardly.

Also shown is bolt release 24 and bolt stop 26. As shown in more detail in the other figures, bolt stop actuator 18, when urged upward by the follower of an empty magazine, displaces bolt stop 26 upwardly into a position such that it interferes with the face of the assembled firearm's bolt and holding it toward the rear of the firearm. A user may depress bolt release 24, which is formed as a single unitary body with bolt stop 26, which lowers bolt stop 26 thereby releasing the bolt of the assembled firearm.

Bolt stop 26 includes projection 32. An underside surface of projection 32 contacts an upper surface 34 (shown in FIG. 4) of leg 26. Bolt stop 26 is biased downward by a spring and, in turn, biases bolt stop actuator 18 downwardly.

Figure 2:
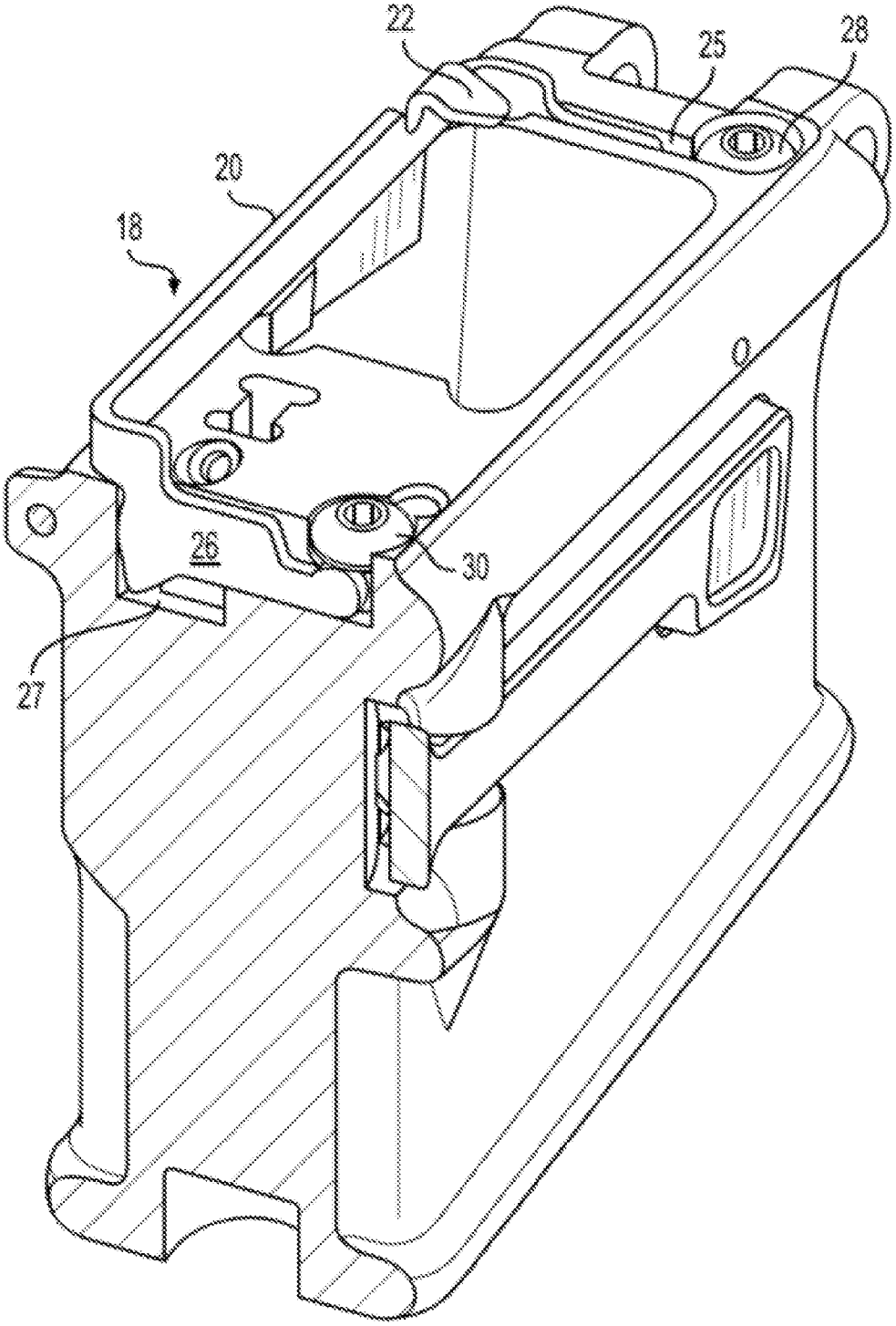
FIG. 2, is a partial cutaway, perspective view of the receiver of FIG. 1.
Figure 3:
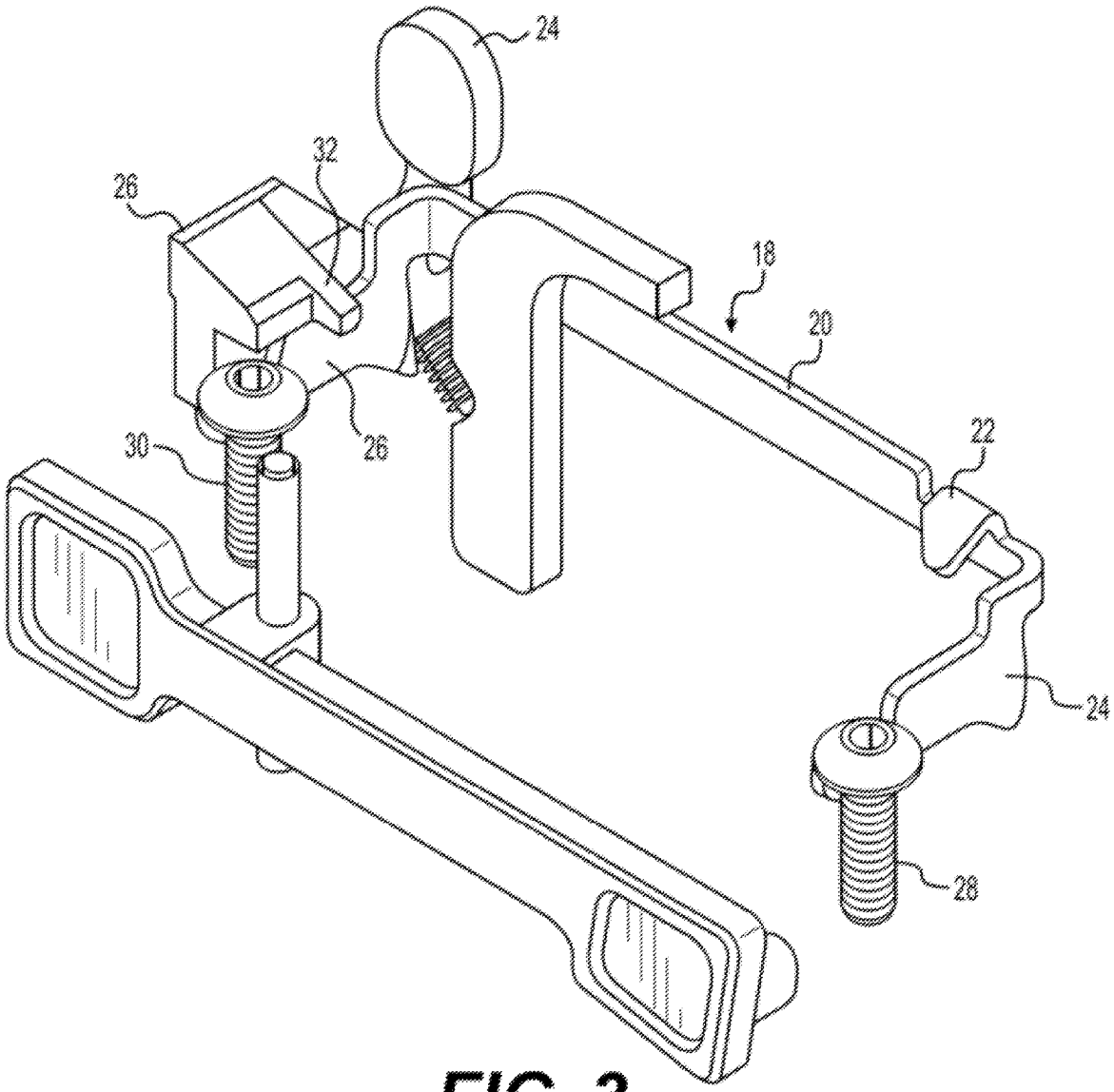
FIG. 3, is a perspective view of a bolt stop and bolt stop assembly actuator.

Referring to FIGS. 2 and 3, bolt stop actuator 18 further includes legs 24 and 26 extending from lift arm 20. In some embodiments, the legs may be generally parallel to each other. In some such embodiments the legs may extend generally perpendicular to the lift arm. Legs 24 and 26 are received in slots 25 and 27 within receiver 10. Bolt stop actuator 18 is retained within receiver 10 by the heads of screws 28 and 30. An underside surface of the heads of screws 28 and 30 restrict the motion of bolt actuator 18 at the ends of legs 24 and 26 distal to lift arm 20.

Figure 4:
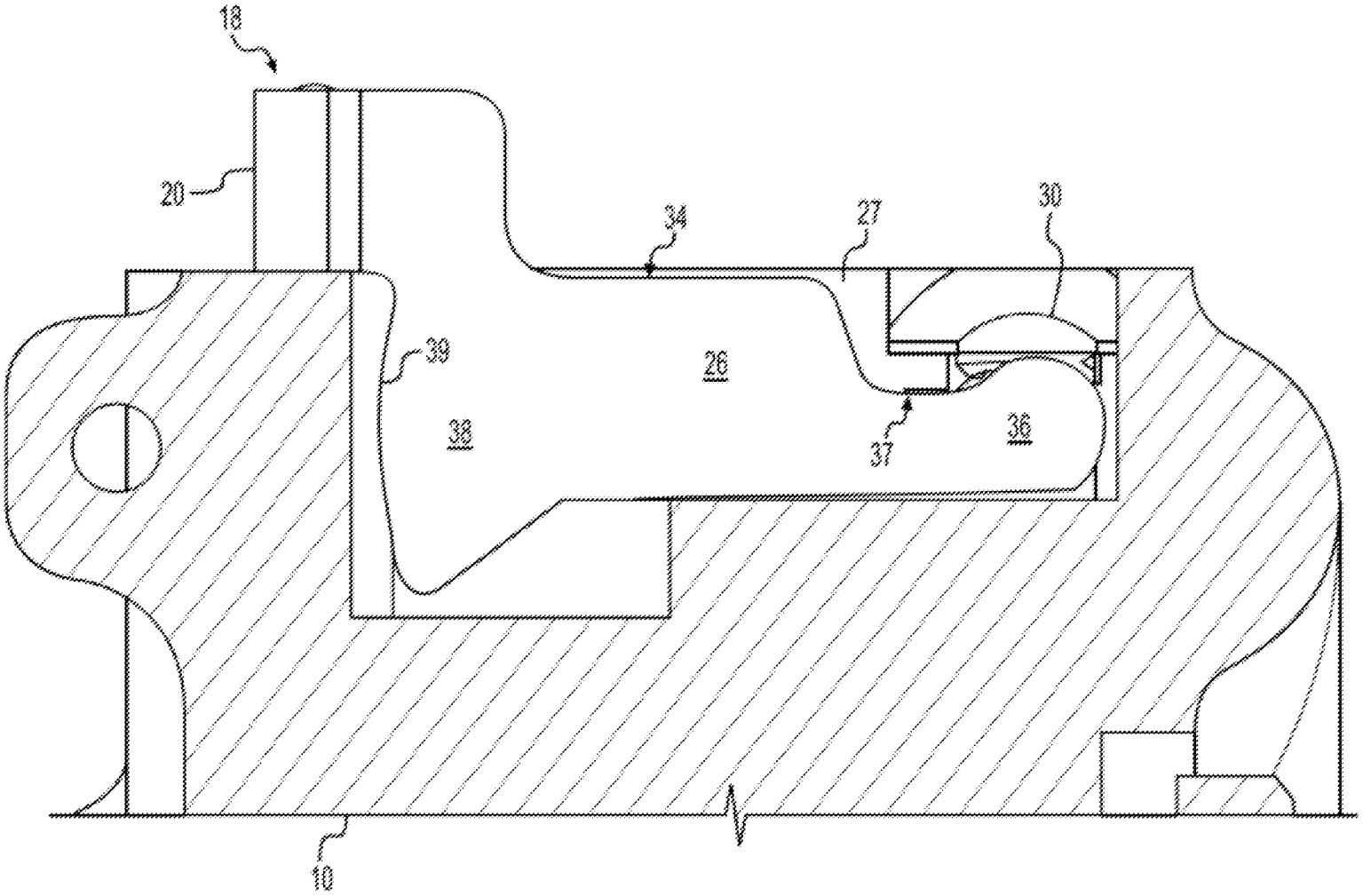
FIG. 4, is a partial, elevation view of the receiver of FIG. 1.

Referring to FIG. 4, bolt stop actuator 18 is shown in a first, unengaged position where it sits relatively low in receiver 10. Leg 26 is disposed within slot 27. Leg 26 includes an end 36 positioned distal to lift arm 20. An underside surface of the head of screw 30 may contact end 36 and retain bolt stop actuator 18 within receiver 10. Region 38 of leg 26 includes an arcuate edge 39 that may maintain contact with an interior surface of slot 27 as bolt stop actuator 18 moves upward.

Figure 5:
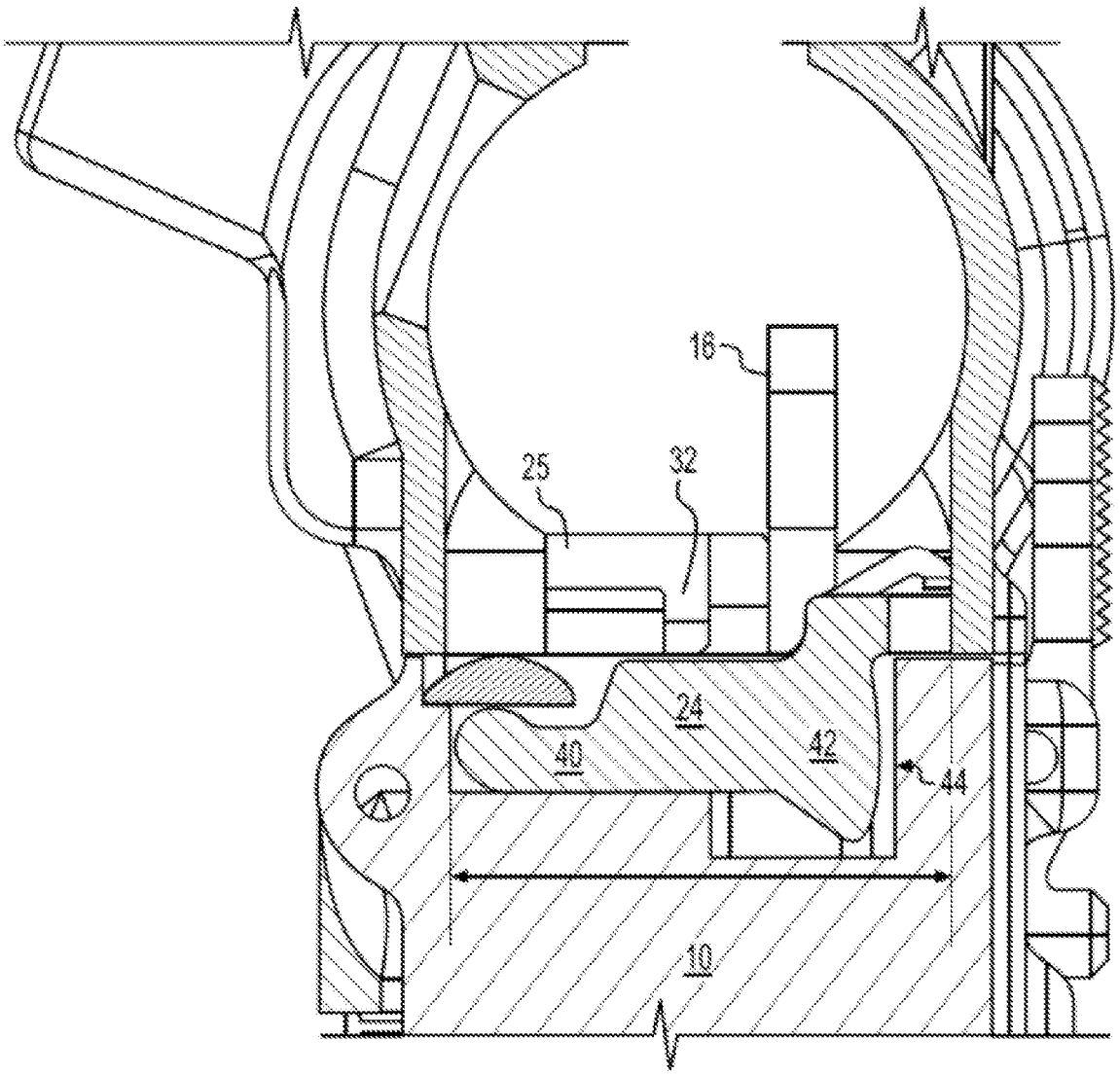
FIG. 5, is a partial, elevation view of the receiver of FIG. 1 with the bolt stop actuator in a first, unengaged position.

Referring to FIG. 5, bolt stop actuator 18 is shown in a first, unengaged position where it sits relatively low in receiver 10. Leg 24 is disposed within slot 25. Leg 24 includes an end 40 positioned distal to lift arm 20. An underside surface of the head of screw 28 may contact end 40 and retain bolt stop actuator 18 within receiver 10. Region 42 of leg 24 includes an arcuate edge 46 that may maintain contact with an interior surface 44 of slot 25 as bolt stop actuator 18 moves.

Figure 6:
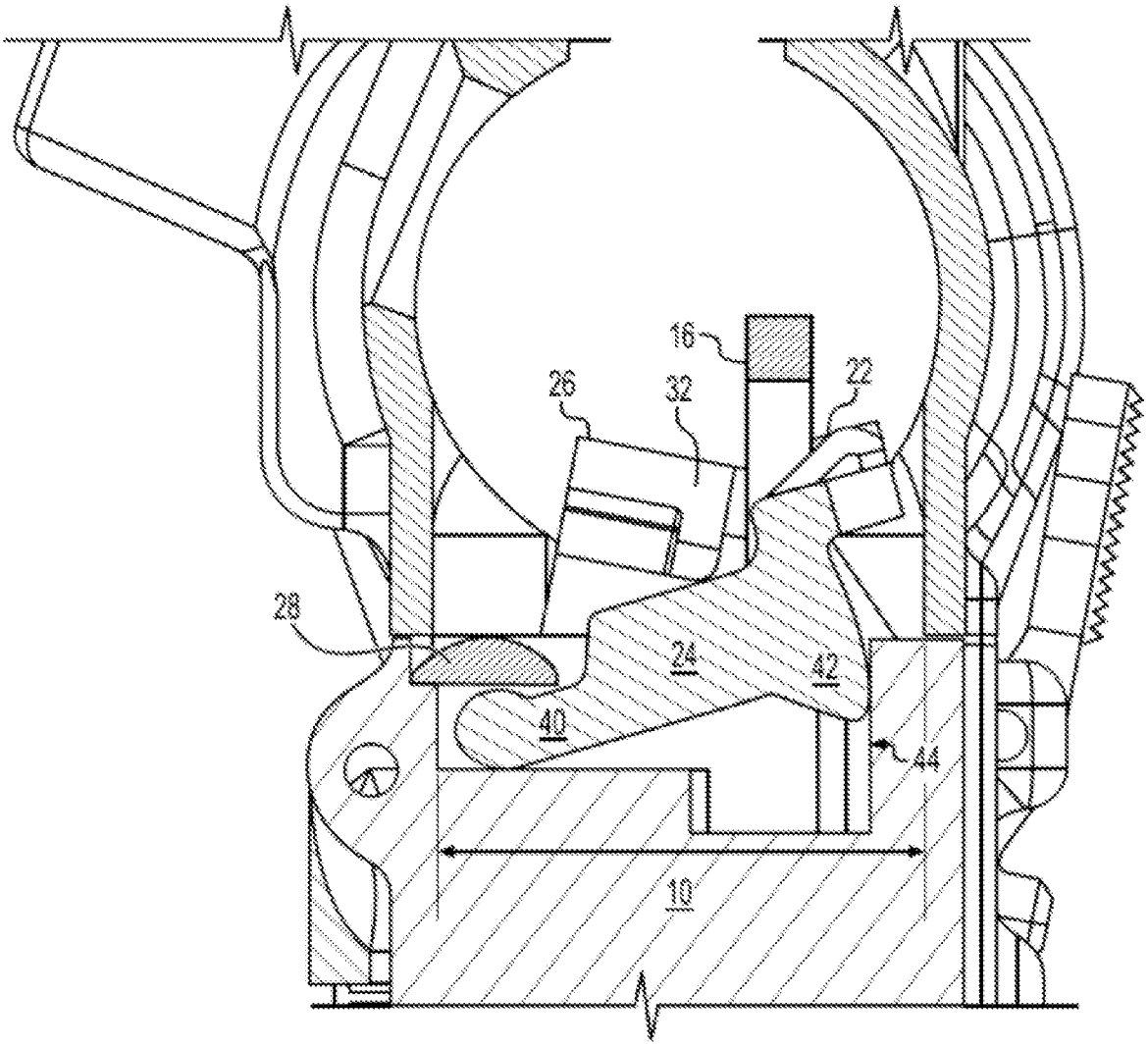
FIG. 6, is a partial, elevation view of the receiver of FIG. 1 with the bolt stop actuator in a second, engaged position.

Referring to FIG. 6, bolt stop actuator 18 is shown in a second, engaged position where it is raised in receiver 10. Leg 24 is disposed within slot 25. Leg 24 includes an end 42 positioned distal to lift arm 20. An underside surface of the head of screw 28 maintains contact with end 40 and retains bolt stop actuator 18 within receiver 10. Region 42 of leg 24 includes an arcuate edge 46 that may maintain contact with an interior surface 44 of slot 25 as bolt stop actuator 18 moves upward.

When the follower of an empty magazine pushes upward on projection 22, bolt stop actuator 18 is moved upwards. This places an upward force on projection 32 of bolt stop 26 proximate to surface 34. Bolt stop 26 is thereby moved upwards into the path of travel of the firearm bolt and retains it in a position to the rear of the firearm. As actuator 18 moves upward near region 42, it both slides laterally and pivots near end 40. The resulting movement places actuator in a position where the distance from a fixed point of the receiver proximate to surface 44 to the furthest edge of end 40 is reduced. Measurements of this are provided on FIGS. 5 and 6 are provided for purposes of illustration only. This results in the ends of legs 24 and 26 distal to lift bar 20 being restricted in the vertical, but not in the horizontal. This results in an actuator that does not truly pivot as there is no fixed pivot point.

In some embodiments, the receiver surface 44 may have a curved profile. This may be used to accomplish the lifting of the lift bar while preventing lateral movement of the bolt stop actuator. Alternatively, other configurations preventing lateral movement of the bolt stop actuator may be used.

In some embodiments, screws 28 and 30 may be replaced by other types of fasteners. In yet other embodiments tabs or other structures extending from an interior surface of the receiver may be used to restrict vertical movement of the legs distal to the lift arm.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

The terminology used in the description herein is for the purpose of describing particular embodiments only and is not intended to be limiting of the invention. As used in the description of the embodiments and the appended claims, the singular forms "a", "an" and "the" are intended to include the plural forms as well, unless the context clearly indicates otherwise.

Unless otherwise defined, all technical and scientific terms used herein have the same meaning as commonly understood by one of ordinary skill in the art to which this invention belongs. All publications, patent applications, patents, and other references mentioned herein are incorporated by reference in their entirety.

It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that relative terms are intended to encompass different orientations of the device in addition to the orientation depicted in the Figures.

Moreover, it will be understood that although the terms first and second are used herein to describe various features, elements, regions, layers and/or sections, these features, elements, regions, layers and/or sections should not be limited by these terms. These terms are only used to distinguish one feature, element, region, layer or section from another feature, element, region, layer or section. Thus, a first feature, element, region, layer or section discussed below could be termed a second feature, element, region, layer or section, and similarly, a second without departing from the teachings of the present invention.

Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

The scope of the disclosure is not intended to be limited to the embodiments shown herein, but is to be accorded the full scope consistent with the claims, wherein reference to an element in the singular is not intended to mean "one and only one" unless specifically so stated, but rather "one or more." All structural and functional equivalents to the elements of the various embodiments described throughout this disclosure that are known or later come to be known to those of ordinary skill in the art are expressly incorporated herein by reference and are intended to be encompassed by the claims.

What is claimed is:

1. A method of actuating a bolt stop comprising:

actuating a bolt stop from a first configuration to a second configuration;

wherein the first configuration being one of an unengaged position or an engaged position, the second configuration being either the unselected, the unengaged position, or the unselected engaged position;

mounting a bolt stop actuator to a receiver, the bolt stop actuator further comprises a lift arm, a projection, a first leg, and a second leg; a wherein the unengaged position comprises:

engaging an underside surface of a first screw head with an end position of the first leg, and engaging an underside surface of a second screw head with an end position of the second leg;

wherein the engaged position comprises:

engaging a first arcuate edge with a first interior surface of a firearm receiver, the first arcuate edge being distal to the end position of the first leg, and engaging a second arcuate edge with a second interior surface of the firearm receiver, the second arcuate edge being distal to the end position of the second leg; and wherein actuating the bolt stop from the first configuration to the second configuration further comprises laterally displacing the bolt stop actuator when moving from the first configuration to the second configuration.

2. The method of claim 1, wherein the unengaged position further comprises biasing the bolt stop, such that the bolt stop does not interfere with a firearm bolt.

3. The method of claim 2, wherein the biasing the bolt stop further comprises applying a downward force to the bolt stop with a tension, the tension being exerted from a tension element.

4. The method of claim 2, further comprising causing an underside surface projection of the bolt stop to contact an upper surface of the bolt stop actuator, such that the bolt stop actuator is biased in the same direction as the bolt stop.

5. The method of claim 1, wherein the engaged position further comprises urging upwardly the projection when a follower of an empty magazine contacts the projection, the projection being curved from a top portion of the lift arm.

6. The method of claim 5, wherein the urging upwardly the projection further comprises displacing the bolt stop actuator upwards, such that the bolt stop actuator slides laterally, pivots near an end position of the first leg, and pivots an the end position of the second leg.

7. The method of claim 6, wherein the displacing the bolt stop actuator upwards further comprises reducing a first distance from a first fixed point of the receiver to a furthest edge of the end position of the first leg, such that the bolt stop actuator does not pivot at a fixed point.

8. The method of claim 6, wherein the displacing the bolt stop actuator upwards further comprises reducing a second distance from a second fixed point of the receiver to a furthest edge of the end position of the second leg, such that the bolt stop actuator does not pivot at a fixed point.

9. The method of claim 6, displacing the bolt stop actuator upwards further comprises applying an upward force on the underside surface projection of the bolt stop from the upper surface of the bolt stop actuator.

10. The method of claim 6, displacing the bolt stop actuator upwards further comprises raising the bolt stop in the receiver, such that the bolt stop interferes with the firearm bolt, holding the firearm bolt towards a rear position of a firearm.

11. The method of claim 6, displacing the bolt stop actuator upwards further comprises releasing the firearm bolt from the rear position of the firearm by a user depressing a bolt release, which is formed as a single unitary body with the bolt stop, which lowers the bolt stop thereby releasing the firearm bolt.

12. A method of retaining a bolt stop actuator comprising:

retaining a bolt stop actuator in a receiver, such that the bolt stop actuator is retained in a firearm in either an unengaged position or an engaged position;

wherein the unengaged position comprises engaging an underside surface of a first screw head with an end position of a first leg of the bolt stop actuator, and engaging an underside surface of a second screw head with an end position of the second leg of the bolt stop actuator; and wherein the engaged position comprises engaging a first arcuate edge with a first interior surface of a firearm receiver, the first arcuate edge being distal to the end position of the first leg, and engaging a second arcuate edge with a second interior surface of the firearm receiver, the second arcuate edge being distal to the end position of the second leg; and wherein retaining the bolt stop actuator in the receiver further comprises displacing the bolt stop actuator, such that the bolt stop actuator is laterally displaced when a lift arm is moved from a first position to a second position.

13. The method of claim 12, wherein retaining the bolt stop actuator in the receiver further comprises restricting a vertical movement of the bolt stop actuator within the receiver by the distal end of the first leg contacting the underside surface of the first screw head.

14. The method of claim 12, wherein retaining the bolt stop actuator in the receiver further comprises restricting the vertical movement of the bolt stop actuator within the receiver by the distal end of the second leg contacting the underside surface of the second screw head.

15. The method of claim 12, wherein retaining the bolt stop actuator in the receiver further comprises restricting the movement of the bolt stop actuator within the receiver by the first arcuate edge configured to maintain contact with the first interior surface of the receiver as the bolt stop actuator moves between the first position and the second position.

16. The method of claim 12, wherein retaining the bolt stop actuator in the receiver further comprises restricting the movement of the bolt stop actuator within receiver by the second arcuate edge configured to maintain contact with the second interior surface of the receiver as the bolt stop actuator moves between the first position and the second position.

17. The method of claim 12, wherein retaining the bolt stop actuator in the receiver further comprises restricting the vertical movement of the bolt stop actuator within the receiver by a force applied by an underside surface of the bolt stop containing an upper surface of the bolt stop actuator.

* * * * *